United States Patent [19]

Merges

[11] Patent Number: 5,010,914

[45] Date of Patent: Apr. 30, 1991

[54] WIG

[76] Inventor: Heinz Merges, Herzogstrasse 29, D-5000 Koeln 1, Fed. Rep. of Germany

[21] Appl. No.: 393,730

[22] Filed: Aug. 15, 1989

[30] Foreign Application Priority Data

May 30, 1989 [DE] Fed. Rep. of Germany ... 8906608[U]

[51] Int. Cl.[5] ..... A41G 5/00

[52] U.S. Cl. ..... 132/54; 132/53

[58] Field of Search ..... 132/53, 54, 56, 201, 132/213; 434/81, 83, 94, 377, 395, 399, 396; 2/198

[56] References Cited

U.S. PATENT DOCUMENTS

| | | | |
|---|---|---|---|
| D. 144,151 | 3/1946 | Arpin | 2/198 |
| 3,068,487 | 12/1962 | Hain | 2/198 |
| 3,143,117 | 8/1964 | Ruud | 2/198 |
| 3,447,726 | 6/1969 | George | 132/54 |
| 4,254,784 | 3/1981 | Belson | 132/53 |

*Primary Examiner*—John J. Wilson
*Assistant Examiner*—Adriene B. Lepiane
*Attorney, Agent, or Firm*—Diller, Ramik & Wight

[57] ABSTRACT

A hair-piece includes a support member (10) for hair shaped like the calotte of the head and including a basket-like configuration made of rods (12, 13) radiating from a crown area. The adjacent pairs of rods define an intermediate space (14) which each extend continuously and uninterruptedly from the crown area. The outer surfaces of the rods (12, 13) are covered with hair.

9 Claims, 3 Drawing Sheets

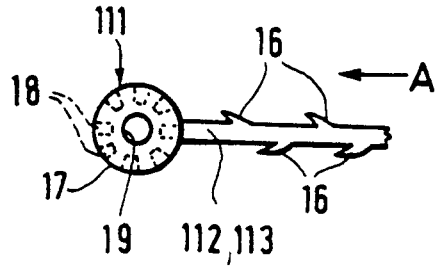
FIG. 4
FIG. 5
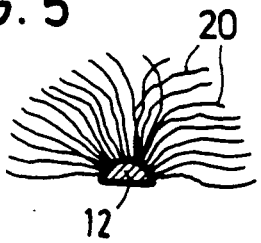
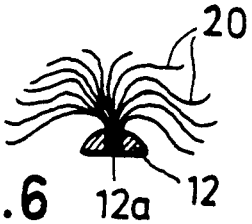
FIG. 6
FIG. 7
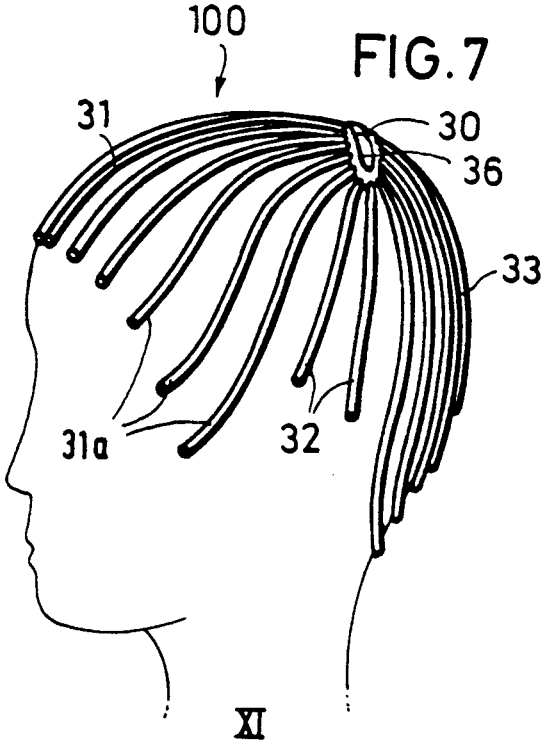
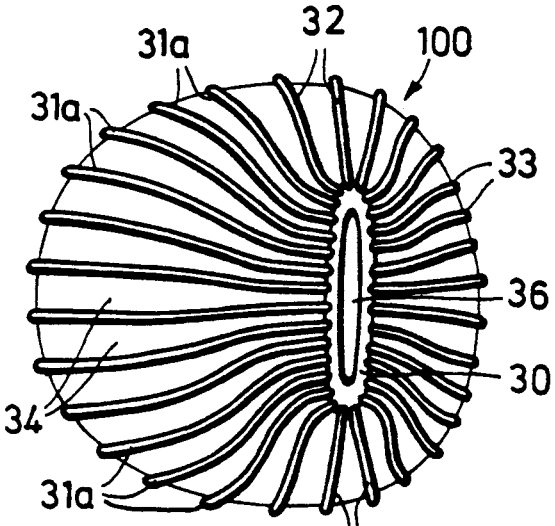
FIG. 8
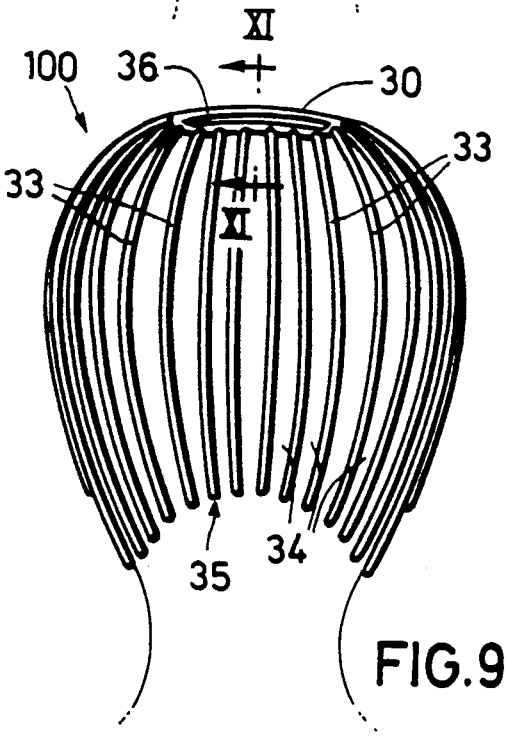
FIG. 9

WIG

BACKGROUND OF THE INVENTION

The invention relates to a hair-piece having a support member for hair, shaped like the calotte of the head and consisting of curved webs.

1. Field of the Invention

A support member of wigs consists of a close-fitting textile substrate adapted to the shape of the head, into which the artificial or the natural "false" hair is knotted. Such a support member sits on the head like a cap and entirely covers the real hair of the person wearing the wig, so that the wearer's own hair is no longer effective. In order to obtain a secure fixation of the wig on the head, it has to be tightly stretched over the head. This causes some inconvenience for the user without reliably avoiding a displacement of the wig. Moreover, the skin of the head is preventing from breathing. In order to overcome the disadvantages of wigs with a cap-like support member, hairpieces have been provided that supplement the user's own hair, which allow a combination of one's own hair and artificial or natural supplementary hair.

2. Description of the Related Art

A known hair-piece (DE 1 460 165) has a support member shaped like a head calotte and having curved webs provided with hair and extending across the head transversally. Both ends of each web are fastened to a closed frame of a cap-like contour. The webs and the frame form a grid having openings transversally extending across the head and being closed all around through which a person's own hair may be drawn in order to mix the user's own hair and supplementary hair. Lateral webs are provided for reducing the size of the openings. Pulling hair through the grid openings is troublesome and requires great care and a lot of time in order to hide the frame and the webs lying on the head like a cap under the wearer's own hair. At the hairline, the frame is tongue-shaped and predetermines a shape of the hairline that does not correspond to the natural course of the hairline and cannot be adapted by the user. Hairpieces manufactured in mass production are practically unusable, since webs and frames of plastic material have to be adapted to the individual form of a head, prior to their drying and curing, in order to obtain a certain fitting of the hair-piece.

Curved webs, extending transversally across the head, are also provided in another known hair-piece (DE 14 60 168). Both ends of the webs, formed as arched members, are fastened to a lateral holding or clamping piece to be arranged behind the temple above and/or in front of the user's ear. This results in lunulate openings for the user's own hair that are very narrow in the vicinity of the ears. Pulling the wearer's own hair through the openings closed all around is not easy to be done. If the distances between the webs are widened in order to facilitate the pulling through of the hair, the thin own hair of the user would collapse too much, so that the hair-piece would be distinct from the user's own hair and no seemingly natural mixture of hair could be obtained. Dressing the hair at the front hairline is difficult, since the frontmost web spans the head above the forehead in a hoop-like manner and defines a limit line of the hair that does not correspond to a natural hairline and does not allow an adaptation to individual needs. The latter is a particularly serious problem if a person's own hair is not sufficient to cover that web. If they hold the hair-piece sufficiently tight, the two holding or clamping pieces can be painful to the user. When the hair-piece is made in mass production, a secure hold and a good fitting cannot be achieved for every head, since the distance between the crown and the ears, as well as the diameter of the head, which are decisive for a close fitting of the support member on the head and the clamping effect of the clamping pieces, are different with every individual. The known hair-piece does not allow a modification in order to adapt it to the individual shape of the head and the hairdo of the user.

SUMMARY OF THE INVENTION

It is the object of the invention to improve a hair-piece having a support member for hair, shaped like the calotte of the head and consisting of curved webs, such that it facilitates pulling the wearer's hair through the openings between the webs and provides a natural look of the mixed hair, including the hairline.

This object is solved according to the invention by providing the support member as a basket of freely ending rods starting from a crown area, each pair of rods defining a space between them that continuously extends to the free ends of the rods.

In this manner a spider-like structure is obtained, the rods of which, extending radially and being curved to form a basket, are pushed on the head from behind, sliding on the skin of the head with the free ends until the crown portion that practically is the bottom of the "basket" sits close on the head. The rods are submerged under the user's own hair already during this procedure. In order to draw all of a person's own hair out between the rods, a pointed object, e.g. a hair pin or a comb with a handle, is drawn from the hairline towards the crown area of the hair-piece, the hair in the respective space between two rods being lifted easily. This procedure can be done quickly and easily and the uniform mixture of the user's own hair and the supplementary hair is subsequently combed over the support member which results in natural looking full hair. Since the rods also end freely in the area of the hairline, this critical area is open to the front and the rods extend to the natural hairline without delimiting it transversally. The support member according to the invention even allows to run through one's fingers through the hair. Since the rods are elastically resilient in the direction of their curvature, a uniform size of the support member will fit on many different heads and span them with an even holding force, so that the hair-piece may be manufactured as a cheap mass product.

Should the shape of the head, the kind of hairline or the desired hairdo require so, the rods, preferably made of plastic material, may be optionally shortened by simply cutting them off. To this avail, they are preferably flat or of a small circular diameter. Generally, the desired effect of the hair-piece is decisive for the length of the rods. Starting from the crown area, they may extend over the entire upper head or may be distributed and dimensioned such that they are only present on parts of the upper head. The crown area may be arranged eccentrically, so that it is situated in the upper region of the back of the head and that the rods extending to the front are longer than the rest of the rods. This results in a very good close fitting of the support member. Moreover, it is advantageous to have a strong hair concentration occur at the back of the head where it is often particularly desired. Should the shape of the head and the hairdo of the wearer of the hair-piece require so, the crown area may be arranged substantially centrally with respect to the rods.

The crown area has a knot piece from which the rods extend in star-shape. In this case, the knot piece is e.g. a round plate from which the rods extend radially. The resulting intermediate spaces are about triangular. Since in a narrow arrangement of the rods the acute angle might hinder the drawing out of hair, longitudinal knot pieces are preferred. Such a knot piece extends across the support member and the rods extend therefrom in an almost parallel arrangement with respect to each other, so that they define almost rectangular spaces. The longitudinal knot piece is a bar member spanning the head almost on the connection line between the ends of the ear conches. The knot pieces may each have a passage for a fastening element like a hair pin or a hair grip.

The knot piece and the rods extending radially therefrom may be integrally extruded from plastic material. In order to obtain a greater density of supplementary hair, a great number of rods are provided; however, a reasonable width of the spaces has to be left open for drawing the wearer's own hair through easily. The angle of the triangular spaces or the distances of parallel rods may vary, thus also allowing adaptations to different densities of the user's own hair and hairdo. A gap between rods may be provided at the back portion of the hair-piece, which has the effect that, when laying back the head, the hair piece is not pushed forward by a rod end hitting the neck. This is particularly advantageous with an eccentrically arranged crown area. It may also prove advantageous to shorten the rods in the area of the back of the head, forming a clipping, or to bend some rods apart.

The hair may be fastened to the rods directly by glueing, clamping or welding. In this context, the knot piece is preferably designed as a separate member to which the rods may be detachably connected. In this way, the user of the hair-piece can regulate the desired density and/or the insertion of colored strands of supplementary hair himself by removing or adding rods. Moreover, the hair-piece may be used as a demonstration model for e.g. different colors of strands that, prior to the dying of his own hair, can give the user a good impression of the later effect and help him to choose the color. In order to arrive at the detachable connection, the knot piece may be provided as a plate having radial pockets into which the rods may be detachably inserted.

A certain hold of the support member is obtained due to the insertion of the freely ending rods of the support member into a person's own hair. An additional fastening is feasible, however. To this avail, a fastening pin may be put through the passage in the knot piece into a knot of hair below the knot piece. A further possibility of fastening the support member is achieved by providing at least one longitudinal edge of at least some of the rods with barbs the openings of which face the crown area. Since these barbs are oriented towards the crown area, they do not hinder a drawing out of the wearer's own hair from the hairline towards the crown area.

In a preferred embodiment of the invention, the hair may be fastened to holders connectable to the rods. These holders may preferably consist of hoses that may be slipped onto the rods. Fastening the hair to the hoses may be done by glueing, clamping and/or welding. If the hoses can be slipped onto the rods detachably, an assortment of hose ends provided with hair dyed in different colors may be associated with a support member, so that various effects of the supplementary hair may be obtained, e.g. for demonstration purposes. Moreover, fastening the hair to the hoses is expedient for reasons of production and for better transportability in the form of reeled up hoses. Preferably, the hoses are flattened and the hair is applied on their outer flat side. In this manner, the hair is closer to the skin of the head and the support surface—seen in the transversal direction of the hose—is enlarged compared to a hose of circular cross section. Slipping the hose onto the rods is facilitated by providing the inside of the hoses and the outside of the rods with a longitudinal ribbing. The rods may be curved once or several times in the plane parallel to the skin of the head. The slipped-on hoses follow that course resiliently.

The hoses may be as long as the rods onto which they are slipped, or longer. In the latter case, the shorter rods projecting from the crown area are mere studs on which to slip the hoses that then act as basket-forming rods themselves.

BRIEF DESCRIPTION OF THE DRAWINGS

Preferred embodiments of the invention are schematically illustrated in the drawings in which FIG. 4 is the knot piece with a modified rod, FIGS. 5 and 6 are cross sections of two rods being connected with natural or artificial hair in different manners, FIGS. 7–10 are lateral, top plan, rear and front views of a second embodiment of the support meber without hair thereon.

DESCRIPTION OF THE PREFERRED EMBODIMENTS

Figure 1:
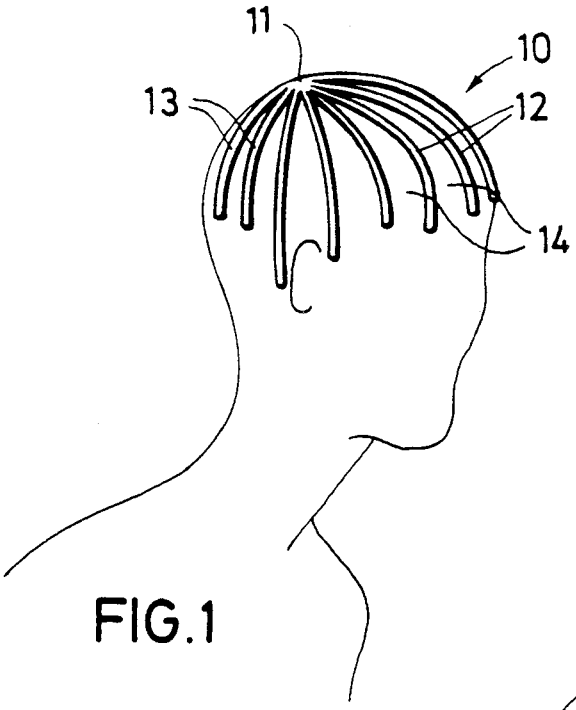
FIG. 1 is a perspective view of a support member without hair thereon.
Figure 2:
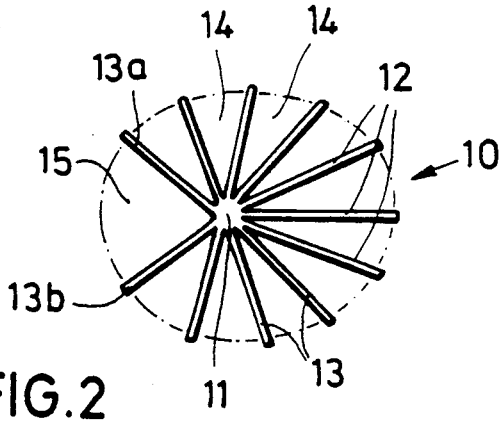
FIG. 2 is a top plan view of the support member of FIG. 1.
Figure 3:
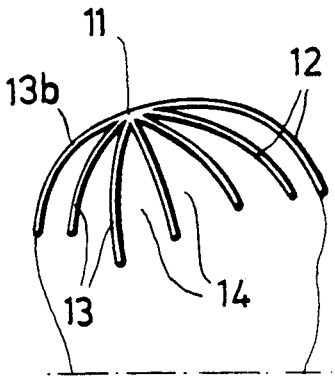
FIG. 3 is a lateral view of the support member of FIGS. 1 and 2.
Figure 10:
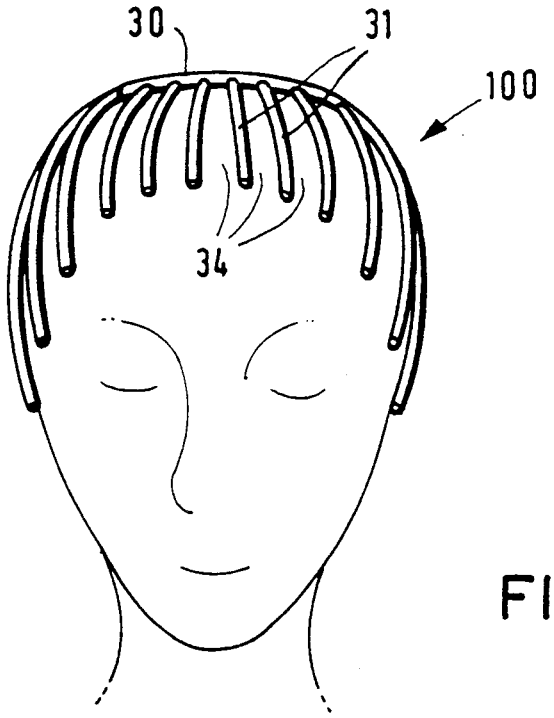

A support member 10, shaped like the calotte of a head, of a hair-piece substantially consists of a plurality of resilient rods 12 and 13 of plastic material, curved to form a basket, which extend radially from a circular knot piece 11 and may be of different lengths. The plate-like flat knot piece 11 may be integrally formed with the rods 12, 13 by producing the support member 10 in an extrusion process, the rods being of either a circular or a flattened cross section and having a smooth outer surface without projections. In the embodiment of FIGS. 1–3, the knot piece is arranged eccentrically with respect to the calotte of the head, so that it rests on the back of the head of a user. The front rods 12 are associated with the front part of the head and extend toward the hairline at which they end freely. According to the respective course of the hairline and the desired hairdo, the rods 12 may be shortened by cutting. Rods 13 are shorter than the front rods 12 and extend radially from the knot piece 11 across the sides and the back of the head. An optional shortening of these rods by cutting is possible as well, so that certain effects and adaptations to the head and the hairdo of the user may be obtained by unequal lengths of the rods.

Rods 12 and 13 enclose almost triangular spaces 14 in pairs, the points of which lie at the knot piece 11 and which are open and free of transversal webs over their entire extension. The angles between rods 12, 13 may be coincident or different for groups of rods in order to vary the number of rods 12, 13 in dependence from the density of the user's own hair. A larger angle between two rods 13*a*, 13*b* is provided in the plane of the nose in the region of the back of the head of the support member 10, which results in a gap 15 in the circle of rods 12, 13. It is the effect of this gap 14 that the wearer of the hair-piece may lay back his head without being hindered by the rods (FIG.2).

Figure 1A:
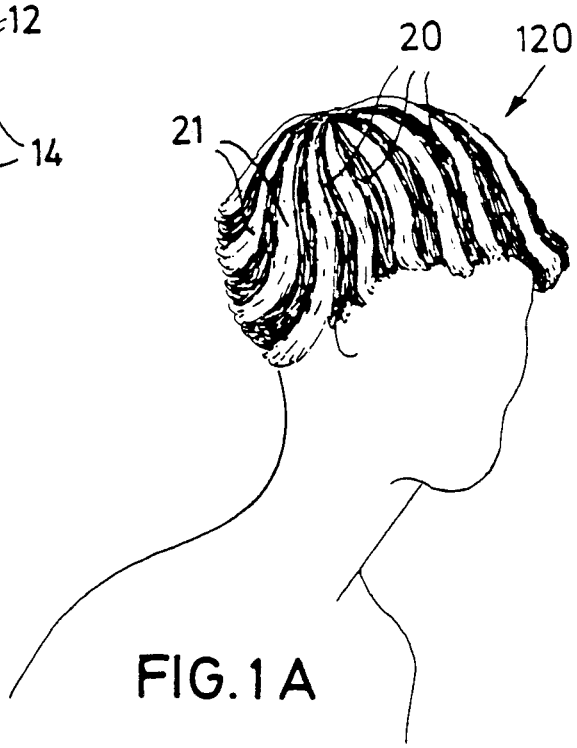
FIG. 1A is a perspective view of the support member of FIG. 1 with hair thereon.

Each rod 12, 13 and the knot piece 11 bear hair on the surface facing away from user's head, which hair may be optionally dyed and/or waved (FIG. 1A). The hair-piece is pushed on the head of the user from behind, such that the free dull ends of rods 12, 13 slide over the skin of the head until knot piece 11 abuts on the back of the head. Then, a pointed object is applied at the hair-line, i.e. in the region of the free ends of all rods 12,13, which object is drawn over the skin of the head through each triangular space 14 towards knot piece 11. In doing so, the user's own hair 21 (FIG. 1A) is drawn out easily and may be uniformly mixed with the supplementary hair 20, such that the user's thin own hair 21 is filled up by the hair-piece 120, thus obtaining a voluminous hairdo in which also the hairline looks natural due to the freely ending rods 12.

Hair pins may be inserted into the area of knot piece 11 between the cylindrical even rods 12, 13 in order to fix the hair-piece 120 on the head. Alternatively, each rod 112,113 (FIG.4) may be lined with barbs 16 the openings of which face the knot piece 111, so that, upon drawing out the user's hair in the direction of the arrow A with the help of an object moved over the skin of the head, the barbs 16 are not hindering. In the embodiment of FIG. 4, the knot piece 111 is formed as a circular plate 17 having a central hole 19 open at the top and the bottom, through which a so-called rider pin may be inserted into a knot of hair at the back of the head by turning. Rider pins are coiled and provide for a good hold of the hair-piece 120 on the head. Radially oriented pockets 18, open to the outside, are distributed over the circumference of the plate 17. Each pocket 18 serves for the clamping reception of an adapted end of a rod 12, 13 or 112, 113 that may be optionally pulled out of the pockets 18. In this way, it is possible to change rods having different hair and the hair-piece 120 may be used as a demonstration object.

The way the hair 20 is fastened to the rods 12, 13 or 112,113 is illustrated in FIGS. 6 and 7. In order to enlarge the surface of each rod 12, 13, 112, 113 on which to fasten hair, the rod is preferably formed with a semi-circular cross section, the round portion facing outward, as shown in FIGS. 5 and 6 with respect to rod 12. According to FIG. 5, longer and/or shorter hair 20 is glued or welded onto the semi-circular outer surface along the entire length of rod 12.

In FIG. 6, the rod 12 is longitudinally parted with hair 20 being clamped into the clamping gap 12*a*. Both longitudinal halves of rod 12 are subsequently adherently connected.

Whereas in the embodiment of FIGS. 1 to 3 and 4 the knot piece 11 or 111 was a circular plate, the knot piece 30 of the hair-piece 100 according to FIGS. 7 to 10 is provided as a longitudinal bar, the longitudinal axis extending in the plane of the ears of the wearer of the hair-piece. The longitudinal knot piece 30 forms the crown area situated in the upper portion of the back of the head, from which rods 31,32,33 extend peripherally that are bent such that the support member 100 forms a basket-like structure receiving the head fittingly. Since the rods 31, 32, 33 are resilient, a support member 100 will fit on various forms and sizes of heads. The longitudinal shape of the knot piece 30 allows to let the front rods 31 and the rear rods 33 extend from the knot piece 30 such that they extend in parallel for the greater part and that the intermediate spaces 34 are of almost the same width at the upper and at the lower ends. Avoiding acute angles facilitates drawing out the wearer's own hair between the rods. In addition to their curvature, the front rods 31*a*, associated with both ends of the knot piece 30, are bent at least once in the plane of the head surface for adaptation to the shape of the head, thereby achieving a natural adaptation of the course of the hair of the hair-piece to a hairdo. The lateral rods 32 and the end rods 33 may also be bent in the plane of the head. A clipping 35 at the lower edge of the rear rods 33 prevents any inconvenience to the wearer of the hair-piece when laying back his head.

Knot piece 30 that may be integrally formed as an extruded part with rods 31, 32, 33 has a central longitudinal slot 36 serving as a passage for hair pins or the like which are inserted into a braided knot of hair beneath knot piece 30 and which secure hair-piece 100 against displacement.

Figure 11:
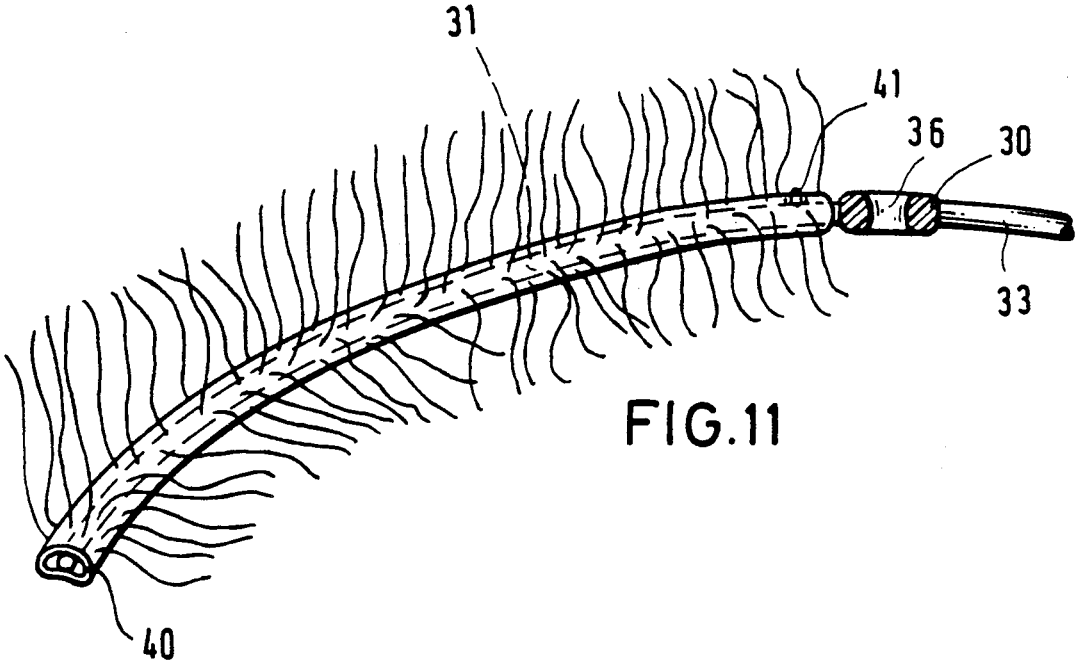
FIG. 11 is a rod with a slipped-on hair-carrying hose.

In the embodiment illustrated, rods 31, 32, 33 are of circular cross section. Contrary to FIGS. 5 and 6, the hair is not provided directly on the rods but on hoses 40 that may be clampingly slipped onto rods 31, 32, 33 and which, due to their flexibility, adapt to the form of the rods. The length of each hose 40 corresponds to the length of the rod 31, 32, 33 for which it is destined. For a secure connection of rods 31, 32, 33 with hoses 40, one end of the hoses is provided with a hole on the side bearing the hair, which, when hose 40 is slipped onto a rod, receives a pin 41 protruding from rods 31, 32, 33 in the vicinity of the knot piece (FIG. 11). If it is intended to use the support member 100 and the hoses 40 to demonstrate hair tints, securing means may be omitted in order to facilitate pulling the hoses off the rods 31, 32, 33.

In order to maximize the hair-bearing surface on hoses 40, they are flattened, as shown in the final view of the arrangement according to FIG. 11, so that they may receive rod 31, 32, 33 having a circular cross section, but extend beyond the rod on two parallel sides. Moreover, this form is advantageous, since it provides a close fitting to the skin of the head and the hair sits closer to the skin of the head.

I claim:

1. A wig adapted to be worn by a person to cover a bald spot comprising a support member (10) for hair shaped like the calotte of the head and including curved webs, said support member (10) being formed as a basket of rods (12, 13) radiating from a crown area and defining in pairs an intermediate space (14) continuously and uninterruptedly extending from said crown area to a free end of each of said rods (12, 13), and outer surfaces of said rods (12, 13) are directly covered with and carry hair secured thereto whereby said support member (10) and hair can be applied to and removed from a person's bald spot.

2. The wig according to claim 1, characterized in that said crown area is provided with a knot piece (11) from which said rods (12, 13) radiate.

3. The wig according to claim 1, characterized in that said crown area is provided with a knot piece (30) extending in transverse relationship across said support member (100) and from which said rods (31, 32, 33) start generally parallel to each other.

4. The wig according to claim 1, characterized in that at least some of said rods (112, 113) are provided with barbs (16) on at least one longitudinal edge, and said barbs define openings which face a knot piece (111).

5. The wig according to claim 2, characterized in that at least some of said rods (112, 113) are detachably connectable with the knot piece (111).

6. A wig adapted to be worn by a person to cover a bald spot comprising a support member (10) for hair shaped like the calotte of the head and including curved webs, said support member (10) being formed as a basket of rods (12, 13) radiating from a crown area and defining in pairs an intermediate space (14) continuously and uninterruptedly extending from said crown area to a free end of each of said rods (12, 13), outer surfaces of said rods (12, 13) are directly covered with and carry hair secured thereto whereby said support member (10) and hair can be applied to and removed from a person's bald spot, and the hair is fastened to holders connected to said rods (31, 32, 33).

7. The wig according to claim 6, characterized in that said holders are hoses (40) slipped onto said rods (31, 32, 33).

8. The wig according to claim 7, characterized in that said hoses (40) are flattened to define an outer flat side, and the hair is fastened to said outer flat sides.

9. The wig according to claim 6, characterized in that said hoses (4) are generally at least equal in length to the rods (31, 32, 33) onto which they are slipped.

* * * * *